US010633755B2

(12) United States Patent
Rohde et al.

(10) Patent No.: US 10,633,755 B2
(45) Date of Patent: Apr. 28, 2020

(54) COPPER PLATING BATH COMPOSITION AND METHOD FOR DEPOSITION OF COPPER

(71) Applicant: Atotech Deutschland GmbH, Berlin (DE)

(72) Inventors: Dirk Rohde, Berlin (DE); Jens Palm, Berlin (DE)

(73) Assignee: Atotech Deutschland GmbH, Berlin (DE)

( * ) Notice: Subject to any disclaimer, the term of this patent is extended or adjusted under 35 U.S.C. 154(b) by 299 days.

(21) Appl. No.: 15/754,008

(22) PCT Filed: Sep. 9, 2016

(86) PCT No.: PCT/EP2016/071309

§ 371 (c)(1),
(2) Date: Feb. 21, 2018

(87) PCT Pub. No.: WO2017/042334

PCT Pub. Date: Mar. 16, 2017

(65) Prior Publication Data

US 2018/0237932 A1 Aug. 23, 2018

(30) Foreign Application Priority Data

Sep. 10, 2015 (EP) ..... 15184663

(51) Int. Cl.
*C25D 3/38* (2006.01)
*C25D 7/00* (2006.01)
(Continued)

(52) U.S. Cl.
CPC ..... *C25D 3/38* (2013.01); *C25D 3/58* (2013.01); *C25D 7/00* (2013.01); *C25D 7/12* (2013.01)

(58) Field of Classification Search
CPC ... C25D 3/38; C25D 3/58; C25D 7/00; C25D 7/12
See application file for complete search history.

(56) References Cited

U.S. PATENT DOCUMENTS 4,036,711 A * 7/1977 Kardos ..... C25D 3/38 205/296
5,976,341 A 11/1999 Schumacher et al.
(Continued)

FOREIGN PATENT DOCUMENTS

DE 1000204 1/1957
GB 1603446 A * 11/1981 ..... C25D 3/22

OTHER PUBLICATIONS

PCT/EP2016/071309; PCT International Search Report and Written Opinion of the International Searching Authority dated Nov. 8, 2016.

*Primary Examiner* — Louis J Rufo
(74) *Attorney, Agent, or Firm* — Renner, Otto, Boisselle & Sklar, LLP

(57) ABSTRACT

The present invention relates to aqueous acidic plating baths for copper deposition in the manufacture of printed circuit boards, IC substrates, semiconducting and glass devices for electronic applications. The plating bath according to the present invention comprises at least one source of copper ions, at least one acid and an additive obtainable by a reaction of at least one aminoglycidyl compound comprising at least one amino group which bears at least one glycidyl moiety and at least one second compound selected from ammonia and amine compounds wherein the amine compounds comprise at least one primary or secondary amino group with the proviso that the aminoglycidyl compound contains at least one polyoxyalkylene residue and/or the amine compound contains at least one polyoxyalkylene residue. The plating bath is particularly useful for filling
(Continued)

recessed structures with copper and build-up of pillar bump structures.

20 Claims, 1 Drawing Sheet

(51) Int. Cl.
*C25D 3/58* (2006.01)
*C25D 7/12* (2006.01)

(56) References Cited

U.S. PATENT DOCUMENTS

| | | | | |
|---|---|---|---|---|
| 6,099,711 | A | 8/2000 | Dahms et al. | |
| 6,610,192 | B1 | 8/2003 | Step et al. | |
| 6,800,188 | B2 | 10/2004 | Hagiwara et al. | |
| 7,128,822 | B2 | 10/2006 | Wang et al. | |
| 7,510,639 | B2 | 3/2009 | Wang et al. | |
| 8,679,316 | B2 | 3/2014 | Brunner et al. | |
| 9,011,666 | B2 | 4/2015 | Roeger-Goepfert et al. | |
| 9,506,158 | B2 | 11/2016 | Rohde et al. | |
| 9,551,080 | B2 | 1/2017 | Brunner et al. | |
| 2003/0106802 | A1 | 6/2003 | Hagiwara et al. | |
| 2004/0138075 | A1 | 7/2004 | Brown et al. | |
| 2012/0024711 | A1* | 2/2012 | Roeger-Goepfert ..... | C25D 3/58 205/112 |
| 2012/0118750 | A1 | 5/2012 | Roeger-Goepfert et al. | |
| 2013/0043137 | A1* | 2/2013 | Yasuda ..... | C07D 295/08 205/298 |

* cited by examiner

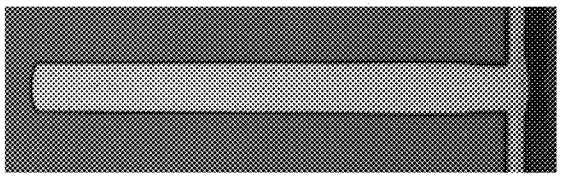

COPPER PLATING BATH COMPOSITION AND METHOD FOR DEPOSITION OF COPPER

The present application is a U.S. National Stage Application based on and claiming benefit and priority under 35 U.S.C. § 371 of International Application No. PCT/EP2016/071309, filed 9 Sep. 2016, which in turn claims benefit of and priority to European Application No. 15184663.1 filed 10 Sep. 2015, the entirety of both of which is hereby incorporated herein by reference.

FIELD OF THE INVENTION

The invention relates to additives and plating bath compositions for electro-deposition of copper. The plating bath compositions are suitable in the manufacture of printed circuit boards, IC substrates and the like as well as for metallization of semiconducting and glass substrates.

BACKGROUND OF THE INVENTION

Aqueous acidic plating baths for electrolytic deposition of copper are used for manufacturing of printed circuit boards and IC substrates where fine structures like trenches, through holes (TH), blind micro vias (BMV) and pillar bumps need to be filled or build up with copper. Another application of such electrolytic deposition of copper is filling of recessed structures such as through silicon vias (TSV) and dual damascene plating or forming redistribution layers (RDL) and pillar bumps in and on semiconducting substrates. Still another application which is becoming more demanding is filling through glass vias, i.e. holes and related recessed structures in glass substrates with copper or copper alloys by electroplating.

EP 2 199 315 A1 reports that alkoxylated polyalkanolamines can be used in the electrolytic copper deposition of recessed structures such as vias and trenches.

U.S. Pat. No. 6,800,188 B2 relates to levellers formed by condensation of glycidyl ethers and amine compounds and the respective ammonium derivatives thereof to be used in electrolytic copper bath formulations.

US patent application 2013/0043137 teaches the use of condensation products derived from triglycidylether compounds and amines in the electrolytic deposition of copper in recessed structures of minute circuit patterns and small holes such as blind via-holes and the like.

U.S. Pat. No. 6,610,192 relates to levelling agents derived from the reaction of cyclic amines with epihalohydrin to be used in electrolytic copper fillings of small voids.

U.S. Pat. No. 7,128,822 B2 describes the use of products formed by a three-component reaction of secondary or tertiary amines with glycols and spacer groups such as epichlorohydrin in the electrolytic deposition of copper in recessed structures. Said reaction products possess a dual-functionality as leveller and suppressor.

EP 1 619 274 B1 reports that the use of many of the above-mentioned levellers results in too rough copper surfaces (comparative examples 3 and 4 therein). The document suggests using more than one leveller in order to solve this issue. However, this is undesirable from the point of application.

The German patent DE 1 000 204 B relates to additives to be used in electrolytic copper deposition which bear a 1,3-Bis-(N,N'-alkylamino)-propan-2-ol moiety to increase the hardness of the formed copper alloys.

However, such additives in acidic copper plating baths are not suitable to fulfil the current and future requirements in manufacture of advanced printed circuit boards, IC substrates and metallization of semiconducting and glass substrates. Depending on the circuitry layout, BMVs' in printed circuit boards and IC substrates need to be filled with copper completely and not only conformally. Typical requirements for BMV filling are for example: obtaining a completely filled BMV while depositing no more than 10 to 15 μm of copper onto the neighbouring planar substrate areas and at the same time creating a dimple on the outer surface of the filled BMV of no more than 0 to 10 μm.

In metallization of semiconducting wafers, TSV filling must lead to a complete and void-free filling with copper while creating no more than ⅕ of via diameter of overplated copper onto the neighbouring planar areas. Similar requirements are demanded for filling through glass vias with copper.

OBJECTIVE OF THE INVENTION

Thus, it is an objective of the present invention to provide an aqueous acidic copper electroplating bath for electrolytic deposition of copper which fulfils the requirements for the above mentioned applications in the field of printed circuit board and IC substrate manufacturing as well as metallisation of semiconducting substrates like TSV filling, dual damascene plating, deposition of redistribution layers or pillar bumping and filling of through glass vias.

SUMMARY OF THE INVENTION

This objective is solved by the aqueous acidic copper electroplating bath according to claim 1.

These objectives are further solved by the method for deposition of copper onto a substrate according to the invention comprising the steps (i) providing a substrate and (ii) contacting the substrate with an aqueous acidic copper electroplating bath according to claim 1, (iii) applying an electrical current between the substrate and at least one anode, and thereby depositing copper onto the substrate.

Recessed structures such as trenches, blind micro vias (BMVs'), through silicon vias (TSVs'), through holes and through glass vias can be filled with copper deposited from the aqueous acidic copper electroplating bath according to the present invention. The copper filled recessed structures are void-free and have an acceptable dimple, i.e. a planar or an almost planar surface. Furthermore, the build-up of pillar bump structures is feasible. The inventive aqueous acidic copper electroplating bath allows for an improved filling speed of recessed structures, i.e. recessed structures can be filled in a shorter period of time compared to conventional methods (compare experiments summarized in Table 7).

BRIEF DESCRIPTION OF THE FIGURE

FIG. 1 is a picture of a TSV filled with copper having used an aqueous acidic copper electroplating bath according to the invention (as described in inventive example 16).

DETAILED DESCRIPTION OF THE INVENTION

The aqueous acidic copper electroplating bath according to the invention which comprises at least one source of copper ions and at least one acid is characterized in that it comprises at least one additive obtainable by a reaction of at least one aminoglycidyl compound and at least one compound selected from ammonia and amine compounds wherein the amine compounds comprise at least one primary or secondary amino group with the proviso that the aminoglycidyl compound and/or the amine compound contains at least one polyoxyalkylene residue The additives obtainable by a reaction of at least one aminoglycidyl compound comprising at least one amino group which bears at least one glycidyl moiety and ammonia and/or at least one amine compound comprising at least one primary and/or secondary amino group whereby the aminoglycidyl compound contains at least one polyoxyalkylene residue and/or the amine compound contains at least one polyoxyalkylene residue are herein referred to as "inventive additives". All inventive additives comprise at least one 1,3-bis(amino)propan-2-ol moiety which is further derivatised by at least one polyoxyalkylene residue.

The principal reaction is as depicted in the following reaction scheme:

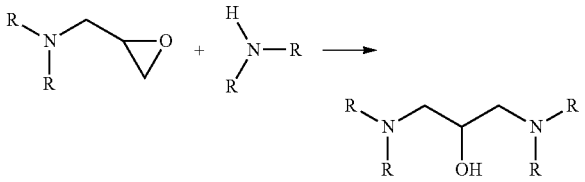

However, reaction products may differ, especially if at least one aminoglycidyl compound comprising more than one amino groups which bear in total at least three glycidyl moieties and an amine compound comprising at least three amino groups are used. They typically result in cross-linked oligomeric or polymeric mixtures of compounds which are extremely difficult to analyse.

Suitable aminoglycidyl compounds can be selected from one or more of (A1) to (A5):

(A1)

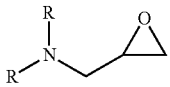

(A2)

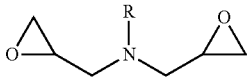

(A3)

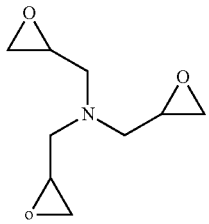

(A4)

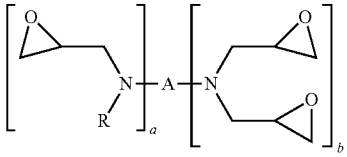

wherein each R is a monovalent residue independently selected from the group consisting of hydrogen, aliphatics, nitrogen-containing aliphatics, aralkyl, aryl, hetaryl, guanyl, ureyl, amidinyl, carbamoyl and polyoxyalkylene; preferably, selected from branched or unbranched, alicyclic and/or cyclic alkyl, branched or unbranched, alicyclic and/or cyclic amino-alkyl, aralkyl, aryl, hetaryl, guanyl, ureyl, amidinyl, carbamoyl and polyoxyalkylene;

A is an (a+b)-valent hydrocarbon residue; A can be saturated, unsaturated and/or aromatic, it can be heteroaromatic, cyclic, heterocyclic and/or alicyclic and branched or unbranched; and a and b are integers each ranging from 0 to 10 with the proviso that the sum of a and b ranges from 2 to 10, a and b preferably range from 0 to 6 with the proviso that the sum of a and b ranges from 2 to 6, more preferably A is a divalent residue selected from the group consisting of alicyclic and/or cyclic, branched or unbranched alkylene of 1 to 12 carbon atoms, arylene and combinations thereof and a and b are integers ranging from 0 to 2 with the proviso that a+b equals 2 to 4, even more preferably, A is bismethylene-cyclohexane derivatives such as

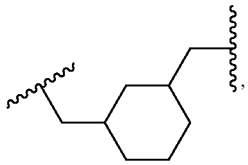

bis-phenylenemethylene such as

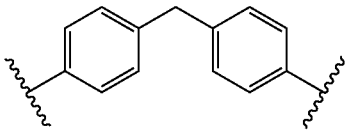

or regioisomers of any of the aforementioned;

(A5)

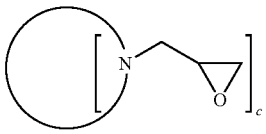

wherein (A5) is a cyclic hydrocarbon optionally comprising further heteroatoms such as nitrogen, sulphur and/or oxygen in the ring and which consists of 4 to 12 carbon and heteroatoms; and c is an integer ranging from 1 to 6.

(A5) is aromatic or non-aromatic. The cyclic hydrocarbon of (A5) consists of 4 to 12 carbon and heteroatoms including the glycidyl moiety bearing nitrogen atoms, preferably, the ring consists of 5 to 8 carbon and heteroatoms. The at least one nitrogen atom bearing the glycidyl moiety is part of the ring. c is an integer ranging from 1 to 6, c preferably ranges from 1 to 3;

preferably, the aminoglycidyl compound (A5) is

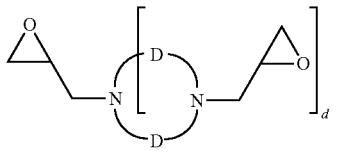

wherein each D is a divalent residue independently selected from each other —$(CH_2)_e$— with e being an integer ranging from 1 to 7, —C(O)—, —$CH_2$—$CH_2$—O—$CH_2$—$CH_2$—, —CH=CH—CH=CH—, —CH=CH—N=CH—, —CH=CH—N=N—, —CH=CH—CH=N—, —CH=CH—CH=CH—CH=N—, —CH=CH—CH=CH—N=CH—, and —CH=CH—CH=N—CH=CH—; D is preferably selected from —$(CH_2)_f$— with f being an integer ranging from 1 to 4 and —C(O)—, and d is an integer ranging from 1 to 6; more preferably, from 1 to 3.

In a preferred embodiment of the present invention, the aminoglycidyl compound is selected from the group consisting of benzyl(glycidyl)amine, N-glycidyldiethylamine, diglycidylamine, diglycidylethylamine, diglycidylmethylamine, diglycidylamine, diglycidylmethylamine, diglycidylethylamine, triglycidylamine, 4,4'-methylenebis(N,N-diglycidylaniline) (also referred to as 4,4'-methylenebis(N,N-bis(oxiran-2-ylmethyl)aniline)), 1,3-bis-(N,N-Diglycidylaminomethyl)cyclohexane, 1,3,5-tris(2-oxiranylmethyl)-1,3,5-triazinane-2,4,6-trione (also referred to as tris(2,3-epoxypropyl)isocyanurate), 1-glycidylpiperidine, 4-glycidylmorpholine, 4-glycidylthiomorpholine, 1-glycidylpiperazine, 1-glycidylimidazol, 1-glycidylpyrazol, 1-glycidylpyrrolidine, 1-glycidyl-2-pyrolidone, 1-glycidyl-2-pyridone, 2-glycidylpyridazin-3-one, 1-furfuryl(glycidyl)amine, furfuryl(glycidyl)amine, glycidyl (tetrahydrofurfuryl)amine, 4-glycidyl-1,4-thiazepane, 1-glycidylazepane, 1-glycidylbenzimidazole, 3-glycidylthieno[2,3-d]pyrimidin-4-one and 3-glycidylthieno[3,2-d]pyrimidin-4-one and the glycidyl, diglycidyl and oligoglycidyl derivatives of polyetheramines, in particular the glycidyl derivatives of polyetheramines in which one or more or all hydrogen atoms of terminal or internal amino groups have been replaced in each case by glycidyl moieties such as the monoglycidyl or diglycidyl derivatives of Jeffamine® M-600, M-1000, M-2005, M-2070, SD-230, SD-401, SD-2001, XJT-435, XTJ-436, and Genamin® M 41/2000, the monoglycidyl, diglycidyl and triglycidyl derivatives of Jeffamine® ST-404, the monoglycidyl, diglycidyl, triglycidyl and tetraglycidyl derivatives of Jeffamine® D-230, D-400, D-2000, D-4000, HK-511, ED-600, ED-900, ED-2003, EDR-143, EDR-176, Genamin® D 01/2000, the monoglycidyl, diglycidyl, triglycidyl, tetraglycidyl, pentaglycidyl and hexaglycidyl derivatives of Jeffamine® T-403, T-3000, T-5000 and the respective glycidyl derivatives of Jeffamine® XTJ-566, XTJ-568 and Baxxodur® EC 301, EC 302, EC 303, EC 310 and EC 311. Polyetheramines are marketed under the trade names Jeffamine® by Huntsman Corporation, Baxxodur® by BASF SE and Genamin® by Clariant International Ltd.

A variety of aminoglycidyl compounds is commercially available and can be used in the synthesis of the inventive additive. Alternatively, the aminoglycidyl compound is readily available by methods known in the art, e.g. from a reaction of the respective amine and epichlorohydrin (see e.g. McKelvey et al., Journal of chemistry 1960, 25, 1424), optionally, in presence of a non-nucleophilic base such as potassium hydroxide. Suitable catalysts such as divalent or polyvalent metal salts of nitric acid may be used (as disclosed in U.S. Pat. No. 8,076,495 B2, column 2, lines 1 to 18).

The aminoglycidyl compound does not contain any glycidyl moieties borne by permanently quaternised ammonium groups because such additives do not allow for good copper filling of recessed structures (see comparative example 1). An example for such compounds is (2,3-epoxypropyl)-trimethylammonium chloride (sometimes referred to as glycidyltrimethyl ammonium chloride).

In one embodiment of the present invention the second compound is an amine compound. Useful amine compounds can be any compound comprising at least one primary and/or secondary amino group. Compounds which are preferably to be used as amine compounds within the scope of the present invention are one or more of alkylamines such as methylamine, ethylamine, propylamine, butylamine, pentylamine, iso-pentylamine, hexylamine; dialkylamines such as dimethylamine, diethylamine, dipropylamine, dibutylamine, dipentylamine, dihexylamine, methylethylamine, methylpropylamine, methylbutylamine, methylpentylamine, methylisopentylamine; alkylarylamines such as N-methylaniline; aralkylamines such as benzylamine and p-toluidine; alkylendiamines or higher homologues thereof having the overall structure of H—$(NH\text{-}G)_g$-$NH_2$ wherein each G is an alkylene residue independently selected from each other G having 1 to 8, preferably 2 to 5, carbon atoms and g is an integer ranging from 1 to 6, preferably from 1 to 4, including exemplarily compounds such as ethylenediamine, diethylenetriamine, triethylenetetramine, diaminopropane, diaminobutane, diaminopentane, diaminohexane, tri(2-aminoethyl)amine, tetra(2-aminoethyl)-amine; cyclic non-aromatic amines of the following structure

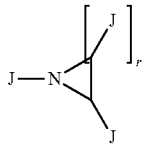

wherein each J is hydrogen, —$CH_2$—$NH_2$ or —$CH_2$—$CH_2$—$NH_2$ and r is an integer ranging from 3 to 6 such as piperazine, N-(2-aminoethyl)piperazine, N,N"-bis(2-aminoethyl)piperazine, N-(2-aminoethyl)piperazine-1,4-diethylamine, preferably, only one or no J is other than hydrogen; arylamines such as phenylamine, 1,2-diaminobenzene, 1,3-diaminobenzene, 1,4-diaminobenzene, 4-chloro-1,3-diaminobenzene, 2,3-diaminophenol, 2,4-diaminophenol, 3,4-diaminophenol, 2,5-diaminophenol, 2,6-diaminophenol, 2-aminophenol, 3-aminophenol, 4-aminophenol, aniline; diarylamines; nitrogen-containing hetaryls with optional amine moieties bound (directly via a carbon-nitrogen bond) to the hetaryl moiety such as imidazol, triazol, tetrazol, 2,4,5,6-tetraminopyrimidine, aminopyridine; amino acids such as glycine, alanine, valine, isoleucine, leucine, phenylalanine, tyrosine, proline, serine, threonine, aspartic acid, glutamic acid; polyetheramines; polyvinyl amines; polyallyl amines; polyethylene imine; guanidines; aminoguanidines; urea, alkylurea, dialkylurea; carbomoyl acid derivatives and esters thereof; amidinyl derivatives and salts such as HCl (hydrochloride) and $H_2SO_4$ (sulphate or hemisulphate) salts and/or hydrates of any of the aforementioned.

Preferably, the at least one second compound is selected from the above-defined amine compounds. More preferred, the at least one second compound is an amine compound is selected from alkylamines, alkylendiamines or higher homologues thereof having the overall structure of H—(NH—$B^1$)$_r$—$NH_2$ wherein each $B^1$ is an alkylene residue independently selected from each other $B^1$ having 2 to 5 carbon atoms, cyclic non-aromatic amines of the following structure

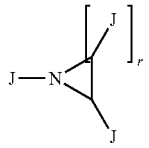

wherein each $B^2$ is hydrogen, —$CH_2$—$NH_2$ or —$CH_2$—$CH_2$—$NH_2$ and b is 3 or 4 with the proviso that only one or no $B^2$ is other than hydrogen, arylamines, nitrogen-containing hetaryls and amines derived therefrom, polyetheramines, aminoguanidines and salts such as HCl (hydrochloride) and $H_2SO_4$ (sulphate or hemisulphate) salts and/or hydrates of any of the aforementioned.

Even more preferred, the amine compound is selected from nitrogen-containing hetaryls with optional amine moieties bound (directly via a carbon-nitrogen bond) to the hetaryl moiety, polyetheramines, aminoguanidines, alkylamines and salts and/or hydrates of any of the aforementioned. Most preferred, the amine compound is a polyetheramine.

The reaction to obtain the inventive additive can preferably be carried out in polar protic solvents or mixtures thereof. Examples for such polar protic solvents are water, alcohols such as methanol and ethanol, acids such as formic acid and acetic acid. Water is most preferred as it is ecologically benign, cheap and it is usually the main component of most plating baths, thus avoiding any time-consuming removal of solvents (or residues thereof). The reaction is typically run in a temperature range of 50 to 100° C., more preferred in a temperature range of 60 to 95° C., most preferred in a range of 80 to 90° C. In certain cases, it may be useful to add a non-nucleophilic base to the reaction mixture such as sodium hydroxide or potassium hydroxide. The amount of said base ranges from 0.1 to 10 wt.-% based on the mass of the solvent, preferably from 1 to 5 wt.-%.

The reaction is typically run for 2 to 24 hours, preferably for 4 to 8 hours. It is useful to run the reaction until the starting materials have been completely consumed which may be outside said time ranges. The consumption of the starting materials can be monitored by standard analytical methods such as chromatography like thin layer chromatography, high performance liquid chromatography or gas chromatography, spectroscopic methods like infrared spectroscopy, UV-Vis spectroscopy, nuclear magnetic resonance spectroscopy, spectrometric methods like mass spectrometry, and chemical analytical methods like titration methods (to determine epoxy and/or amine contents in reaction mixtures).

In one preferred embodiment of the present invention the molar ratio of glycidyl moieties of one or more aminoglycidyl compounds and amino groups of the one or more second compound (i.e. amine compound and/or ammonia) is in the range of 1:0.8 and 1:1.5. In a more preferred embodiment of the present invention the molar ratio of glycidyl moieties of the at least one aminoglycidyl compound and amino groups of the at least one second compound is in the range of 1:0.9 to 1:1.33, even more preferred in a range of 1:0.95 to 1:1. This allows for improved filling results of recessed structures (see inventive examples 10 to 15 as well as 17 and 18, respectively). If more than one aminoglycidyl compound and/or second compound are used in the preparation of the inventive additive, the molar ratio is calculated based on the amount of substance of all glycidyl moieties of all aminoglycidyl compounds and based on the amount of substance of target amino groups of all second compounds.

The inventive additives can be purified if necessary by any means known to those skilled in the art. These methods include precipitation (of products or of undesired impurities), chromatography, distillation, extraction, washing with solvents such as water, flotation or a combination of any of the aforementioned. The purification method to be used depends on the physical properties of the respective compounds present in the reaction mixture and has to be chosen for each individual case. Alternatively, the inventive additives can be used without further purification.

The inventive additive is preferably free of permanently quaternised ammonium moieties as such quaternised ammonium groups, particularly in the 1,3-bisaminopropanol moiety, do not allow for recessed structures to be filled with copper (see comparative example 1). Permanently quaternised ammonium moieties are to be understood as nitrogen atoms bearing four covalent bonds to residues other than hydrogen (e.g. four monovalent residues or residues bound by double and triple bonds) and therefore being permanently charged. Contrary to permanently quaternised ammonium moieties are those temporary ammonium moieties whose nitrogen atoms bear up to three permanent bonds (including those to hydrogen) and are protonated due to acidic media.

Preference is given to those inventive additives which contain a direct linkage of the polyoxyalkylene residues to one of the nitrogen atoms in the 1,3-bisaminopropanol moiety. A direct linkage of polyoxyalkylene residues to one of the nitrogen atoms in said moiety means in the context of the present invention that the nitrogen atoms are bound to the carbon atoms derived from the alkylene oxides which are used to form the polyoxyalkylene residue.

The additives according to the following formula (I) to (III) are particularly preferred for the ease of synthesis, purification and analysis. Facilitated analysis of the inventive additives is advantageous for process control of the plating process.

The additive according to formula (I) e.g. can be prepared by a reaction of one or more aminoglycidyl compounds (A1) to (A3) comprising one amino group which bears one to three glycidyl moieties and one or more amine compounds comprising one primary or secondary amino group. The additive according to formula (I) has the following structure:

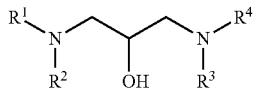

(I)

wherein $R^1$ and $R^2$ are monovalent residues independently from each other selected from the group consisting of hydrogen, aliphatics, nitrogen-containing aliphatics, aryl, hetaryl, alkaryl, carbamoyl, amidinyl, guanyl, ureyl, and polyoxyalkylene; preferably selected from hydrogen, alicyclic and/or cyclic, branched or unbranched alkyl, alicyclic and/or cyclic, branched or unbranched amino-alkyl, aryl, hetaryl, alkaryl, carbamoyl, amidinyl, guanyl, ureyl, and polyoxyalkylene;

$R^3$ and $R^4$ are monovalent residues independently from each other selected from the group consisting of hydrogen, aliphatics, nitrogen-containing aliphatics, aryl, hetaryl, alkaryl and polyoxyalkylene and

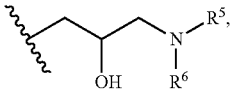

preferably $R^3$ and $R^4$ are preferably selected from hydrogen, alicyclic and/or cyclic, branched or unbranched alkyl, alicyclic and/or cyclic, branched or unbranched amino-alkyl, aryl, hetaryl, alkaryl, carbamoyl, amidinyl, guanyl, ureyl, and polyoxyalkylene, with $R^5$ and $R^6$ being monovalent residues independently from each other selected from the group consisting of hydrogen, aliphatics, nitrogen-containing aliphatics, aryl, hetaryl, alkaryl, carbamoyl, amidinyl, guanyl, ureyl, and polyoxyalkylene; preferably selected from hydrogen, alicyclic and/or cyclic, branched or unbranched alkyl, alicyclic and/or cyclic, branched or unbranched amino-alkyl, aryl, hetaryl, alkaryl, carbamoyl, amidinyl, guanyl, ureyl, and polyoxyalkylene; with the proviso that at least one monovalent residue of $R^1$ to $R^6$ is selected to be polyoxyalkylene.

The additive according to formula (II) e.g. can be prepared by reactions of one or more aminoglycidyl compounds (A4) having two or more amino groups each bearing at least one glycidyl moiety and one or more amine compounds comprising one primary or secondary amino group. The additives according to formula (II) have the following structure:

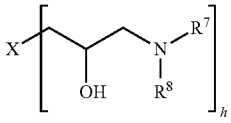

(II)

wherein $R^7$ and $R^8$ are monovalent residues independently from each other selected from the group consisting of hydrogen, aliphatics, nitrogen-containing aliphatics, aryl, hetaryl, alkaryl, carbamoyl, amidinyl, guanyl, ureyl, and polyoxyalkylene; preferably selected from hydrogen, alicyclic and/or cyclic, branched or unbranched alkyl, alicyclic and/or cyclic, branched or unbranched amino-alkyl, aryl, hetaryl, alkaryl, carbamoyl, amidinyl, guanyl, ureyl, and polyoxyalkylene;

h is an integer ranging from 2 to 6, preferably from 2 to 4;

X is an h-valent residue selected from the group consisting of

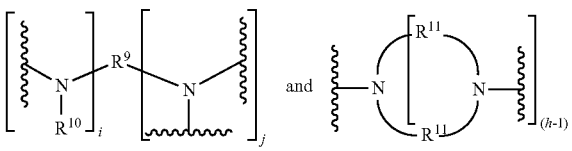

wherein $R^9$ is a linear and/or cyclic, branched or unbranched alkylene of 1 to 12 carbon atoms, arylene and combinations thereof, more preferably, $R^9$ is a bismethylene-cyclohexane derivative such as

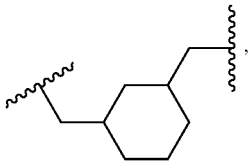

a bis-phenylenemethylene derivative such as

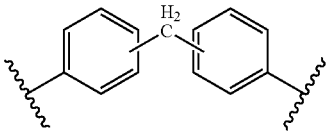

or regioisomers of any of the aforementioned;

$R^{10}$ is a monovalent residue selected from the group consisting of hydrogen, aliphatics, nitrogen-containing aliphatics, aryl, hetaryl, alkaryl and polyoxyalkylene; preferably selected from hydrogen, alicyclic and/or cyclic, branched or unbranched alkyl, alicyclic and/or cyclic, branched or unbranched amino-alkyl, aryl, hetaryl, alkaryl and polyoxyalkylene;

i is an integer ranging from 0 to h and j is an integer ranging from 0 to h/2 with the proviso that the sum of i and 21 equals h;

and each $R^{11}$ is a divalent residue independently selected from each other $—(CH_2)_k—$ with k being an integer ranging from 1 to 7, —C(O)—, $—CH_2—CH_2—O—CH_2—CH_2—$, —CH═CH—CH═CH—, —CH═CH—N═CH—, —CH═CH—N═N—, —CH═CH—CH═N—, —CH═CH—CH═CH—CH═N—, —CH═CH—CH═CH—N═CH—, and —CH═CH—CH═N—CH═CH—; $R^{11}$ is more preferably a divalent residue independently selected from each other from $—(CH_2)_k—$ with each k being an integer ranging from 1 to 4 and —C(O)—; with the proviso that at least one residue of $R^7$ to $R^{10}$ is selected to be polyoxyalkylene.

The ring formed by $R^{11}$ and the nitrogen atoms preferably consists of in total of 4 to 12 carbon and nitrogen atoms, more preferably of 5 to 8.

The additive according to formula (III) can be prepared by reactions of one or more aminoglycidyl compounds (A5) having two or more amino groups each bearing at least one glycidyl moiety and ammonia and/or one or more amine compounds comprising two primary or secondary amino groups. The additives according to formula (II) have the following structure:

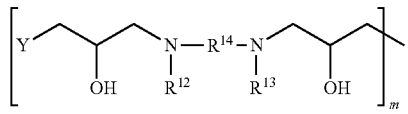

(III)

$R^{12}$ and $R^{13}$ are monovalent residues independently selected from the group consisting of hydrogen, aliphatics, nitrogen-containing aliphatics, aryl, hetaryl, alkaryl, carbamoyl, amidinyl, guanyl, ureyl and polyoxyalkylene; preferably selected from hydrogen, alicyclic and/or cyclic, branched or unbranched alkyl, alicyclic and/or cyclic, branched or unbranched amino-alkyl, aryl, hetaryl, alkaryl, carbamoyl, amidinyl, guanyl, ureyl, and polyoxyalkylene, even more preferably selected from hydrogen and alicyclic and/or cyclic, branched or unbranched alkyl; preferably, $R^{12}$ and $R^{13}$ are selected to be same for the ease of synthesis of the inventive additive;

$R^{14}$ is a divalent residue selected from alicyclic and/or cyclic, branched or unbranched alkylene (preferably comprising 1 to 18 carbon atoms, more preferably 1 to 12), arylene, polyoxyalkylene and combinations thereof, $R^{14}$ is more preferably polyoxyalkylene;

m is an integer ranging from 1 to 25;

Y is an at least divalent residue selected from the group consisting of

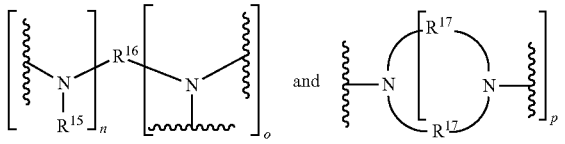

wherein $R^{15}$ is selected from the group consisting of hydrogen, alicyclic and/or cyclic, branched or unbranched alkyl, aryl, aralkyl and polyalkoxylene;

$R^{16}$ is an hydrocarbon residue having a valency of the sum of n and o selected from linear and/or cyclic, branched or unbranched alkylene of 1 to 12 carbon atoms, arylene and combinations thereof, more preferably, $R^{16}$ is a bismethylene-cyclohexane derivatives such as

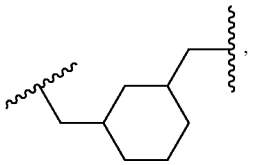

a bis-phenylenemethylene such as

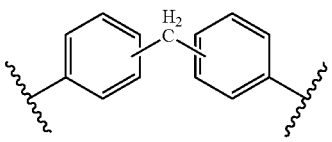

or regioisomers of any of the aforementioned;

n is an integer ranging from 0 to 10, preferably from 0 to 6, and o is an integer ranging from 0 to 10, preferably from 0 to 6, with the proviso that the sum of n and o ranges from 1 to 10, preferably from 2 to 6;

p is an integer ranging from 2 to 5;

each $R^{17}$ is independently selected from each other —$(CH_2)_q$— with q being an integer ranging from 1 to 7, —C(O)—, —$CH_2$—$CH_2$—O—$CH_2$—$CH_2$—, —CH═CH—CH═CH—, —CH═CH—N═CH—, —CH═CH—N═N—, —CH═CH—CH═N—, —CH═CH—CH═CH—CH═N—, —CH═CH—CH═N—CH═CH—, and —CH═CH—CH═N—CH═CH—, preferably selected from —$(CH_2)_q$— with q being an integer ranging from 1 to 4 and —C(O)—; with the proviso that at least one residue of $R^{12}$ to $R^{16}$ is selected to be polyoxyalkylene. The ring formed by $R^{17}$ and the nitrogen atoms preferably consists of in total of 4 to 12 carbon and nitrogen atoms, more preferably of 5 to 8.

The additive obtainable by a reaction of at least one aminoglycidyl compound comprising at least one amino group which bears at least one glycidyl moiety and at least one second compound selected from ammonia and amine compounds wherein the amine compounds comprise at least one primary or secondary amino group with the proviso that the aminoglycidyl compound contains at least one polyoxyalkylene residue and/or the amine compound contains at least one polyoxyalkylene residue in a metal plating bath can be used in a metal or metal alloy plating bath. It can be used as leveller and/or carrier-suppressor, preferably in electrolytic metal or metal alloy baths, more preferably in an electrolytic copper plating bath.

Insofar as the term "aliphatic" is used in this description and in the claims, it refers to non-aromatic hydrocarbon radicals consisting of 1 to about 50 carbon atoms (unless stated otherwise), preferably 1 to 8, more preferably 2 to 5, which may be cyclic and/or linear, branched or unbranched and which may comprise double or triple bonds between adjacent carbon atoms.

Nitrogen-containing aliphatics are aliphatic residues as defined above which additionally comprise nitrogen atoms bound between two or three carbon atoms forming the aliphatic structure and thus contain secondary and/or tertiary amines.

The term aliphatic includes alkyl and amino-alkyl.

Insofar as the term "alkyl" is used in this description and in the claims, it refers to non-aromatic hydrocarbon radicals consisting of 1 to about 50 carbon atoms. Preferably, it comprises 1 to 8, more preferably 2 to 5 carbon atoms (unless stated otherwise). $C_1$-$C_8$-alkyl for example includes, among others, methyl, ethyl, n-propyl, iso-propyl, n-butyl, iso-butyl, tert-butyl, n-pentyl, iso-pentyl, sec-pentyl, tert-pentyl, neo-pentyl, hexyl, heptyl and octyl. Alkyl can be substituted by replacing H-atoms by functional groups, for example amino, hydroxy, halides such as fluorine, chlorine, bromine, iodine, oxo (an oxygen atom bound by a double bond), carbonyl, carboxyl, carboxylic acid esters and so forth. In one embodiment, two H-atoms bound to two adjacent carbon atoms are substituted by one oxygen atom and thus forming a three-membered oxirane (epoxide) ring.

"Alkylene" is the divalent alkyl derivative such as methylene (—$CH_2$—) and ethylene (—$CH_2$—$CH_2$—). Alkylene may consist of 1 to about 50 carbon atoms, preferably it consists of 1 to 8, more preferably 2 to 5 carbon atoms (unless stated otherwise).

"Amino-alkyl" residues are alkyl radicals which comprises one or more, preferably one, nitrogen atoms placed between two or three carbon atoms, thus forming one or more secondary and/or tertiary amine moieties between alkyl chains (e.g. in the alkyl chain or ring), preferably in cyclic moieties.

Insofar as the term "aryl" is used in this description and in the claims, it refers to ring-shaped aromatic hydrocarbon radical, for example phenyl or naphtyl. Furthermore, aryl can be substituted by replacing an H-atom in each case by a functional group, for example amino, hydroxy, halides such as fluorine, chlorine, bromine, iodine, carbonyl, carboxyl, carboxylic acid esters and so forth. Arylene is the divalent aryl derivative such as phenylene (—$C_6H_4$—).

Hetaryl is an aryl derivative where individual ring carbon atoms are replaced by N and/or O, preferably such replacements include only N and more preferably hetaryl is selected from imidazoyl, pyrazolyl, triazolyl, tetrazolyl, pyridinyl, and pyrimidyl.

"Alkaryl" and "aralkyl" are used synonymously herein and refer to combinations of alkyl and aryl as chemical moieties comprising a covalent linkage between at least one alkyl and at least one aryl such as benzyl ($C_6H_5$—$CH_2$—) and toloyl ($CH_3$—$C_6H_4$—). Similarly, combinations of alkylene and arylene are the covalent linkage of at least one alkylene and at least one arylene residue such as bis(4-phenyl)methyl (—$C_6H_4$—$CH_2$—$C_6H_4$—).

Insofar as the term "polyoxyalkylene" is used in this description and in the claims, it refers to radicals which comprise polymers of alkylene oxides, such as ethylene oxide, propylene oxide and/or butylene oxide. Polyoxyalkylene residues are known in the art and also referred to as polyethers. The polyoxyalkylene residues may comprise further alkylene oxides or styrene oxide, typically only in small amounts such as 0.1 to 5 mol-% based on the entire polymer. These further alkylene oxides may be selected from the group consisting of 1-butene oxide, 2,3-butene oxide, 2-methyl-1,2-propene oxide (isobutene oxide), 1-pentene oxide, 2,3-pentene oxide, 2-methyl-1,2-butene oxide, 3-methyl-1,2-butene oxide, 2,3-hexene oxide, 3,4-hexene oxide, 2-methyl-1,2-pentene oxide, 2-ethyl-1,2-butene oxide, 3-methyl-1,2-pentene oxide, decene oxide, 4-methyl-1,2-pentene oxide or styrene oxide. When two or more different alkylene oxides or one or more alkylene oxides and styrene oxide are used, the polyoxyalkylene groups formed may be random copolymers, alternating copolymers, gradient copolymers or block copolymers.

Polyoxyalkylene residues formed by two or more of said monomers are preferred. More preferred are polyoxyalkylene residues formed by the polymerisation of at least propylene oxide and ethylene oxide, even more preferred copolymers formed from propylene oxide and ethylene oxide. It was surprisingly found by the inventors that an increase of the more hydrophobic propylene oxide in the copolymer groups allows for better filling of recessed structures (see inventive examples 1 to 4 and 19 to 21). Hence, polyoxyalkylene residues having been formed by propylene oxide and ethylene oxide in a molecular ratio of at least 0.25 mole propylene oxide per mole ethylene oxide are even more preferred. Yet even more preferred are polyoxyalkylene residues having been formed by propylene oxide and ethylene oxide in a molecular ratio of at least one mole propylene oxide per mole ethylene oxide.

Preferably, the (average) molecular weight $M_w$ of the polyoxyalkylene residue according to the invention is in the range from 100 to 10,000 g/mol, more preferred from 200 to 2000 g/mol, even more preferred from 220 to 700 or 800 g/mol. A smaller molecular weight of the polyoxyalkylene residues in the inventive additive allows for improved copper fillings of the recessed structures (compare e.g. inventive examples 7 and 8).

Methods to determine the (average) molecular weight are widely known in the art. These methods are chosen by the person skilled in the art depending on the particular circumstances. Typical methods are mass spectrometry (mostly for smaller polymers) and gel permeation chromatography (if suitable standards are available). High resolution mass spectrometry is preferred.

The polyoxyalkylene residues may further contain terminating functional groups such as hydroxyl, alkyl, aryl, amino, sulphate, phosphoryl, carboxylic acid esters such as acetyl which are bound to the otherwise terminal hydroxyl group. Polyoxyalkylene can be a monovalent, divalent or residues of higher valency.

Insofar as the term "guanyl" is used in this description and in the claims, it refers to —NH—C(NH)—$NH_2$. The term "ureyl" likewise refers to —NH—C(O)—$NH_2$. "Carbamoyl" represents —C(O)—$NH_2$ and "amidinyl"-C(NH)—$NH_2$. Insofar as the term "glycidyl moiety" is used in this description and in the claims, it refers to 2,3-epoxyprop-1-yl radicals. A diglycidyl (derivative) is to be understood in the context of the present invention to be a compound which comprises two glycidyl moieties which may be bound to the same amino group or to two different amino groups present in said compound. The same applies for the respective higher homologues such as triglycidyl, tetraglycidyl and so forth.

Bonding sites are depicted in skeletal formula as wavy line (∿∿∿) in roughly a 90° angle to the bond to be formed; the bond to be formed is thus shown attaching the wavy line. In condensed formulae they are represented by a hyphen (-).

The term valence (or valency) is defined herein as follows: The maximum number of monovalent (or univalent) atoms (such as hydrogen or chlorine atoms) or residues (molecular fragments) that may combine with an atom of the element under consideration, or with a residue, or for which an atom of this element can be substituted. According to this definition, methyl ($CH_3$—) is a monovalent residue whereas methylene (—$CH_2$—) is a divalent residue.

A combination of any of the aforementioned residues implies that a chemical bond is formed between those.

The concentration of the inventive additive in the aqueous acidic copper electroplating bath preferably ranges from 1 mg/l to 500 mg/l, more preferably from 5 mg/l to 300 mg/l. If more than one inventive additive is used, the concentration of all inventive additives lies in above-defined ranges.

It is possible within the scope of the present invention to use more than one inventive additive in the aqueous acidic copper electroplating bath. Mixtures of inventive additives can be prepared by each using one aminoglycidyl compound and one amine compound in more than one reaction and thereby obtaining the individual inventive additives followed by mixing the thus formed inventive additives in the aqueous acidic copper electroplating bath. Alternatively, it is possible to use more than one aminoglycidyl compound and one or more amine compound and/or one or more aminoglycidyl compound and more than one amine compound in the process to form the inventive additive. Combinations of the two methods to use more than one inventive additive are also feasible.

The aqueous acidic copper electroplating bath according to the invention is an aqueous solution. The term "aqueous solution" means that the prevailing liquid medium, which is the solvent in the solution, is water. Further liquids, that are miscible with water, as for example alcohols and other polar liquids, that are miscible with water, may be added. For ecological reasons, water as the sole solvent is preferred.

The aqueous acidic copper electroplating bath according to the invention may be prepared by dissolving all components in the aqueous liquid medium, preferably in water.

The aqueous acidic copper electroplating bath further contains at least one source of copper ions which is preferably selected from the group consisting of copper sulphate and copper alkyl sulphonates such as copper methane sulphonate. Further copper ion sources can be copper chloride, copper acetate, copper citrate, copper nitrate, copper fluoroborate, copper phenyl sulphonate, copper p-toluene sulphonate. The copper ion concentration in the aqueous acidic copper electroplating bath preferably ranges from 4 g/l to 120 g/l.

The aqueous acidic copper electroplating bath further contains at least one acid which is preferably selected from the group consisting of sulphuric acid, fluoroboric acid, phosphoric acid and methane sulphonic acid and is preferably added in a concentration of 10 g/l to 400 g/l, more preferably from 20 g/l to 300 g/l.

The aqueous acidic copper electroplating bath composition preferably has a pH value of ≤2, more preferably of ≤1.

The aqueous acidic copper electroplating bath preferably further contains at least one accelerator-brightener additive which is selected from the group consisting of thiol-, sulphide-, disulphide- and polysulphide-compounds. Preferred accelerator-brightener additives are selected from the group consisting of 3-(benzthiazolyl-2-thio)-propylsulphonic-acid, 3-mercaptopropan-1-sulphonic acid, ethylendithiodipropylsulphonic-acid, bis-(p-sulphophenyl)-disulphide, bis-(ω-sulphobutyl)-disulphide, bis-(ω-sulphohydroxypropyl)-disulphide, bis-(ω-sulpho-propyl)-disulphide, bis-(ω-sulphopropyl)-sulphide, methyl-(ω-sulphopropyl)-disulphide, methyl-(ω-sulfopropyl)-trisulphide, O-ethyl-dithiocarbonic-acid-S-(ω-sulphopropyl)-ester, thioglycolic acid, thiophosphoric-acid-O-ethyl-bis-(ω-sulphopropyl)-ester, 3-N, N-dimethylaminodithiocarbamoyl-1-propanesulphonic acid, 3,3'-thiobis(1-propanesulphonic acid), thiophosphoric-acid-tris-(ω-sulphopropyl)-ester and their corresponding salts. The concentration of all accelerator-brightener additives optionally present in the aqueous acidic copper bath compositions preferably ranges from 0.01 mg/l to 100 mg/l, more preferably from 0.05 mg/l to 10 mg/l.

The aqueous acidic copper electroplating bath optionally further contains at least one carrier-suppressor additive which is preferably selected from the group consisting of polyvinylalcohol, carboxymethylcellulose, polyethylenglycol, poly-propyleneglycol, stearic acid polyglycolester, alkoxylated naphtoles, oleic acid polyglycolester, stearylalcoholpolyglycolether, nonylphenolpolyglycolether, octanolpolyalkylenglycolether, octanediol-bis-(polyalkylenglycolether), poly(ethylenglycol-ran-propylenglycol), poly (ethylenglycol)-block-poly(propylene-glycol)-block-poly (ethylenglycol), and poly(propylenglycol)-block-poly (ethylenglycol)-block-poly(propylenglycol). More preferably, the optional carrier-suppressor additive is selected from the group consisting of polyethylenglycol, polypropylenglycol, poly(ethylenglycol-ran-propylenglycol), poly(ethylenglycol)-block-poly(propyleneglycol)-block-poly(ethylenglycol), and poly(propylenglycol)-block-poly(ethylenglycol)-block-poly(propylenglycol). The concentration of said optional carrier-suppressor additive preferably ranges from 0.005 g/l to 20 g/l, more preferably from 0.01 g/l to 5 g/l. Carrier-suppressors allow for smoother, more homogeneous copper surfaces with fewer voids to be obtained. However, such optional carrier-suppressor is not required as the inventive additive itself acts as carrier-suppressor.

Optionally, the aqueous acidic copper electroplating bath contains at least one leveller additive selected from the group consisting of nitrogen containing levellers such as polyethyleneimine, alkoxylated polyethyleneimine, alkoxylated lactames and polymers thereof, diethylenetriamine and hexamethylenetetramine, dyes such as Janus Green B, Bismarck Brown Y and Acid Violet 7, sulphur containing amino acids such as cysteine, phenazinium salts and derivatives thereof. Further nitrogen containing levellers can be polyethylenimine bearing peptides, polyethylenimine bearing amino acids, polyvinylalcohol bearing peptides, polyvinylalcohol bearing amino acids, polyalkylenglycol bearing peptides, polyalkylenglycol bearing amino acids, aminoalkylen bearing pyrrols and aminoalkylen bearing pyridines. Suitable ureyl polymers have been disclosed in EP 2735627 A1, said polyalkylenglycol bearing amino acids and peptides are published in EP 2113587 B9 and EP 2537962 A1 teaches suitable aminoalkylene bearing pyrrols and pyridines. The optional further leveller additive is preferably one or more of nitrogen containing levellers. Said optional leveller additive is added to the aqueous acidic copper electroplating bath in amounts of 0.1 mg/l to 100 mg/l. Such leveller additives are known to improve the process stability. However, the optional leveller additive is not necessary as the inventive additive itself acts as leveller.

The aqueous acidic copper electroplating bath optionally further contains at least one source of halide ions, preferably chloride ions in a quantity of 10 mg/l to 200 mg/l, more preferably from 30 mg/l to 60 mg/l. Suitable sources for halide ions are for example hydrochloric acid or alkali halides such as sodium chloride.

Optionally, the aqueous acidic copper electroplating bath may contain at least one wetting agent. These wetting agents are also referred to as surfactants in the art.

The at least one wetting agent may be selected from the group of non-ionic, cationic and/or anionic surfactants and is used in concentration from 0.01 to 5 wt.-%.

In one embodiment of the present invention, a redox couple, such as $Fe^{2+/3+}$ ions is added to the plating bath. Such a redox couple is particularly useful, if reverse pulse plating is used in combination with inert anodes for copper deposition. Suitable processes for copper plating using a redox couple in combination with reverse pulse plating and inert anodes are for example disclosed in U.S. Pat. Nos. 5,976,341 and 6,099,711.

The aqueous acidic copper electroplating bath can be used to deposit copper (disregarding any trace impurities conventionally found in technical raw materials such as less than 1 wt.-%). Such deposition of copper is often referred to as plating in the art.

The method for deposition of copper onto a substrate comprises, in this order, the steps (i) providing a substrate, and (ii) contacting the substrate with an aqueous acidic copper electroplating according to claim 1, and (iii) applying an electrical current between the substrate and at least one anode, and thereby depositing copper onto the substrate.

The substrate is selected from the group consisting of printed circuit boards, IC substrates, semiconducting wafers, ceramics and glass substrates. Preferred are substrates of the aforementioned group which have recessed structures such as trenches, blind micro vias, through silicon vias, through holes and through glass vias. Copper are then deposited into these recessed structures.

The aqueous acidic copper electroplating bath is preferably operated in the method according to the present invention in a temperature range of 15° C. to 50° C., more preferably in a temperature range of 25° C. to 40° C. by applying an electrical current to the substrate and at least one anode. Preferably, a cathodic current density range of 0.05 $A/dm^2$ to 12 $A/dm^2$, more preferably 0.1 $A/dm^2$ to 7 $A/dm^2$ is applied.

The substrate is contacted with the aqueous acidic copper electroplating bath for any time length necessary to deposit the desired amount of copper. This time length preferably ranges from 1 second to 6 hours, more preferably for 5 seconds to 120 minutes, even more preferably for 30 seconds to 75 minutes.

The substrate and the aqueous acidic copper electroplating bath can be contacted by any means known in the art. This includes inter alia immersion of the substrate into the bath or the use of other plating equipment. The aqueous acidic copper electroplating bath according to the present invention can be used for DC plating (direct current plating) and reverse pulse plating. Both inert and soluble anodes can be utilised when depositing copper from the plating bath according to the present invention.

The aqueous acidic copper electroplating bath can be either used in conventional vertical or horizontal plating equipment.

It is a distinct advantage of the present invention that the deposition filling rate of recessed structures is higher compared to those electrolytic copper baths containing conventional accelerator-brighteners known in the art (Table 7).

It is another advantage of the present invention that the inventive additive may be used in the aqueous acidic copper electroplating bath without further leveller and/or carrier-suppressor as the inventive additive has a dual-functionality and acts as leveller and/or carrier-suppressor (see experimental part). The inventive additives allow for copper filling of recessed structures, virtually without defects such as voids or dimples (see also FIG. 1).

The invention will now be illustrated by reference to the following non-limiting examples.

EXAMPLES

The following polyetheramines were used having the following chemical properties:

The general structure of Jeffamine M-600 to M-2070:

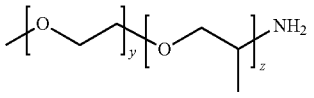

The general structure of Jeffamine ED-600 to ED-900:

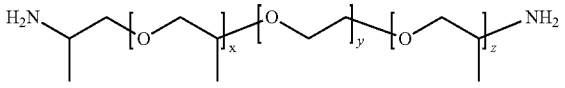

TABLE 1

Properties of polyetheramines.

| Name | $M_w$ | Ratio ethylene oxide/ propylene oxide | Terminal amino groups/molecule |
|---|---|---|---|
| Jeffamine ® M-600 | 600 | 1/9 | 1 |
| Jeffamine ® M-1000 | 1000 | 6.3/1 | 1 |
| Jeffamine ® M-2070 | 2000 | 3.1/1 | 1 |
| Jeffamine ® ED-600 | 600 | 2.5/1 | 2 |
| Jeffamine ® ED-900 | 900 | 2.1/1 | 2 |

Preparation Example 1: Exemplary Preparation of the Inventive Additive

In a round bottom flask equipped with reflux condenser, a solution of 1.0 g 4,4'-Methylene-bis-(N,N-diglycidylaniline) (2.37 mmol, 1.0 eq.) in 120 ml water was prepared prior to the addition of 5.54 g Jeffamine M-600 (9.27 mmol, 3.9 eq.) thereto. The reaction mixture was stirred at 90° C. for 8 hours and then allowed to cool to room temperature. The solid product was isolated by filtration and washed with water. Yield was >90%. Finally, the solid was dissolved without further purification in 0.5 wt.-% sulphuric acid to obtain a 1 wt.-% solution.

Preparation Example 2: Diglycidyl Derivative of Jeffamine M-600

A round bottom flask was charged with 15.0 g epichlorohydrin (162.1 mmol, 1.95 eq.) and the reactant was cooled in an ice bath. Then, 50.0 g Jeffamine M-600 (83.3 mmol, 1.0 eq.) was added slowly so that the temperature of the reaction mixture did not exceed 10° C. Upon complete addition of the second reactant, the reaction mixture was stirred at room temperature for 48 hours. Thereafter, the pH of the solution was adjusted to 7 with an aqueous sodium hydroxide solution (30% (m/v)). The reaction mixture was then extracted with 150 ml diethyl ether and the phase was washed 10 times with 50 ml water each. The ether-phase was subsequently dried over calcium chloride and the solvent was removed under reduced pressure. Finally, the clear viscous product was stored under nitrogen (>90%).

Preparation Example 3

In a round bottom flask equipped with reflux condenser, 3.0 g diglycidyl-Jeffamine M-600 (0.39 mmol, 1.0 eq.) were dissolved in 100 ml water. Then, 0.65 g iso-pentylamine (0.70 mmol, 1.8 eq.) was added to this solution. The reaction mixture was stirred at 90° C. for 8 hours. A suspension was formed which was cooled to room temperature before filtration. The solid product was washed with water. Yield was >90%. Finally, the solid was dissolved without further purification in 0.5 wt.-% sulphuric acid to obtain a 1 wt.-% solution.

Table 1 shows the reaction conditions for the preparation of the inventive additives following the procedure of preparation example 1. The molar ratio given in table 1 refers the molar ratio of aminoglycidyl compound to amine compound. In those cases where more than one amine compound was used the molar ratio is given based on the total amount of substance of all amine compounds listed.

The solvent given in table 1 is the media in which the reaction was carried out, the temperature T gives the temperature at which the reaction was stirred for the given time t after the complete addition of both reactants. Some reactions were carried out in aqueous solutions containing bases such as 5 wt.-% NaOH in water. Percentages given throughout this application are weight-% unless noted otherwise.

TABLE 2

Reaction conditions of the preparation of the inventive additives.

| # | aminoglycidyl compound | amine compound | Molar ratio | Solvent | t [h] | T [° C.] |
|---|---|---|---|---|---|---|
| 1 | Tris(2,3-epoxypropyl)isocyanurate | Jeffamine M-600 | 1:2.9 | $H_2O$ | 8 | 90 |
| 2 | Tris(2,3-epoxypropyl)isocyanurate | Jeffamine M-600 | 1:2.9 | EtOH | 8 | 78 |
| 3 | Tris(2,3-epoxypropyl)isocyanurate | Jeffamine M-2070 | 1:2.9 | $H_2O$ | 6 | 90 |
| 4 | Tris(2,3-epoxypropyl)isocyanurate | Jeffamine M-1000 | 1:2.9 | $H_2O$ | 8 | 90 |
| 5 | Tris(2,3-epoxypropyl)isocyanurate | Mixture of 5 eq. Jeffamine M-600/ 1 eq. M-2070 | 1:2.9 | $H_2O$ | 8 | 90 |
| 6 | Tris(2,3-epoxypropyl)isocyanurate | Mixture of 1 eq. Jeffamine M-600/ 3 eq. M-2070 | 1:2.9 | $H_2O$ | 8 | 90 |
| 7 | Tris(2,3-epoxypropyl)isocyanurate | Jeffamine ED-600 | 1:2.9 | $H_2O$ | 6 | 90 |
| 8 | Tris(2,3-epoxypropyl)isocyanurate | Jeffamine ED-900 | 1:2.9 | $H_2O$ | 6 | 90 |
| 9 | Tris(2,3-epoxypropyl)isocyanurate | Mixture of 1 eq. Jeffamine ED-600/ 1 eq. M-2070 | 1:2.9 | $H_2O$ | 6 | 90 |
| 10 | Tris(2,3-epoxypropyl)isocyanurate | Jeffamine ED-600 | 1:1 | $H_2O$ | 6 | 90 |
| 11 | Tris(2,3-epoxypropyl)isocyanurate | Jeffamine ED-600 | 3:4 | $H_2O$ | 6 | 90 |
| 12 | Tris(2,3-epoxypropyl)isocyanurate | Jeffamine ED-600 | 2:3 | $H_2O$ | 6 | 90 |
| 13 | Tris(2,3-epoxypropyl)isocyanurate | Jeffamine ED-600 | 1:2 | $H_2O$ | 6 | 90 |
| 14 | Tris(2,3-epoxypropyl)isocyanurate | Jeffamine ED-600 | 2:5 | $H_2O$ | 6 | 90 |
| 15 | Tris(2,3-epoxypropyl)isocyanurate | Jeffamine ED-600 | 1:3 | $H_2O$ | 6 | 90 |
| 16 | 4,4'-Methylene-bis (N,N'-diglycidyl-aniline) | Jeffamine M-600 | 1:3.9 | $H_2O$ | 6 | 90 |
| 17 | 4,4'-Methylene-bis (N,N'-diglycidyl-aniline) | Jeffamine M-600 | 1:3.9 | $H_2O$ | 7 | 90 |
| 18 | 4,4'-Methylene-bis (N,N'-diglycidyl-aniline) | Jeffamine M-600 | 1:3 | $H_2O$ | 7 | 90 |
| 19 | 4,4'-Methylene-bis (N,N'-diglycidyl-aniline) | Jeffamine M-600 | 1:3.9 | 1 wt.-% NaOH in $H_2O$ | 7 | 90 |
| 20 | 4,4'-Methylene-bis (N,N'-diglycidyl-aniline) | Jeffamine M-2070 | 1:3.9 | $H_2O$ | 8 | 90 |
| 21 | 4,4'-Methylene-bis (N,N'-diglycidyl-aniline) | Jeffamine M-1000 | 1:3.9 | $H_2O$ | 8 | 90 |
| 22 | N,N-Diglycidyl-Jeffamine M-600 | 2,4,5,6-Tetra-aminopyrimidine sulphate | 1:2 | 5 wt.-% NaOH in $H_2O$ | 8 | 90 |
| 23 | N,N-Diglycidyl-Jeffamine M-600 | Jeffamine M-600 | 1:2 | 5 wt.-% NaOH in $H_2O$ | 7 | 90 |
| 24 | N,N-Diglycidyl-Jeffamine M-600 | Aminoguanidine hemisulphate | 1:2 | 5 wt.-% NaOH in $H_2O$ | 7 | 90 |
| 25 | N,N-Diglycidyl-Jeffamine M-600 | 1-(2-Aminoethyl)-piperazine | 1:2 | 5 wt.-% NaOH in $H_2O$ | 7 | 90 |
| 26 | N,N-Diglycidyl-Jeffamine M-600 | iso-pentylamine | 1:2 | $H_2O$ | 8 | 90 |

Copper Deposition into TSVs:

The inventive additives prepared according to preparation examples 1 to 26 were used as additives for deposition of copper into recessed structures and then subjected to the following test method.

A sufficient TSV filling with copper means that the copper deposit has no or almost no so-called dimple (depression of the copper surface at the point of the TSV). Hence, the copper surface of a sufficiently filled TSV is as even as possible.

An insufficient TSV filling is characterised by a concave structure of the copper deposit, i.e. by a dimple. Voids in a copper filled via are also not desired.

The cross sections of recessed structures filled with copper were investigated with an optical microscope after depositing a protection layer of nickel onto the copper deposit and applying conventional grinding and polishing methods. A copper filled TSV obtained in application example 16 is shown in FIG. 1.

Application of Inventive Examples 1 to 26 and Comparative Examples C1 to C7

Equipment: Hand cell with 1.9 l volume, bath agitation with a pump, soluble copper anodes, separation of anolyte and catholyte by nafion membrane.

Copper Deposition into TSVs

Through-silicon vias (TSVs) in silicon wafer substrates having a width of 10 μm and a depth of 60 μm were filled with copper using an aqueous acidic copper electrolyte comprising 55 g/l copper ions (added as copper sulphate), 50 g/l sulphuric acid, 30 mg/l chloride ions, 0.6 mg/l Bis-(3-sulphopropyl)-disulphide. Soluble anodes and a Nafion® membrane separating anolyte and catholyte were used. A current density of 2 mA/cm$^2$ was applied to the silicon wafer substrates for 50 min in order to fill the TSVs with copper.

The additives as prepared according to the conditions given in Table 2 were added to said electrolyte in concentrations listed in Table 3. The latter table also provides the filling ratio of the TSVs. If more than one concentration is given then, the same filling results were obtained for those concentrations provided in Table 3.

TABLE 3

10 × 60 μm TSV copper filling results of Inventive Examples 1 to 26.

| # | c (additive) [mg/l] | Filling [%] |
|---|---|---|
| 1 | 7/10 | 99 |
| 2 | 10 | 100 |
| 3 | 7/10 | 99 |
| 4 | 3/7/10/40 | 80 |
| 5 | 7/10/20/40 | 99 |
| 6 | 7 | 70 |
| 7 | 10 | 97 |
| 8 | 10 | 75 |
| 9 | 10/20 | 97 |
| 10 | 7/10/20 | 90 |
| 11 | 7 | 95 |
| 12 | 7/10 | 100 |
| 13 | 10 | 99 |
| 14 | 10 | 85 |
| 15 | 20 | 70 |
| 16 | 20 | 100 |
| 17 | 40/200 | 100 |
| 18 | 40/200 | 100 |
| 19 | 40/100/200 | 100 |
| 20 | 7/10 | 80 |
| 21 | 40 | 50 |
| 22 | 7/10 | 100 |
| 23 | 40/100 | 100 |
| 24 | 100 | 100 |
| 25 | 40/100 | 100 |
| 26 | 40/100 | 100 |

Most of the Inventive Examples 1 to 26 showed good filling properties of TSVs. The surfaces of the copper deposits were semi-bright and free of defects. It can be deduced from inventive examples 1-4 and 19-21 that an increase of the more hydrophobic propylene oxide in the copolymer groups allows for better filling of recessed structures. The inventive additive used in inventive example 1 and 2 has polyoxyalkylene residue formed of 9 molar equivalents propylene oxide to 1 molar equivalent ethylene oxide whereas the inventive additive used in inventive example 3 has polyoxyalkylene residue formed of 1 molar equivalents propylene oxide to 3.1 molar equivalent ethylene oxide and the polyoxyalkylene residue of the inventive additive used in inventive example 4 has a molar ratio of propylene oxide to ethylene oxide of 1 to 6.3. It is noteworthy that the polyoxyalkylene residue of inventive example 3 has a higher molecular weight $M_w$ than the polyoxyalkylene residue of inventive example 4. The copper filling rate was best for inventive example 1, negligibly worse for inventive example 3 and the worst for inventive example 4. Similar conclusions can be drawn from examples 19 to 21. In conclusion, the use of polyoxyalkylene residue having been formed by propylene oxide and ethylene oxide in a molecular ratio of at least 0.25 mole propylene oxide per mole ethylene oxide resulted in improved filling behaviours. Inventive examples 7 and 8 only differ in the average molecular weight of the polyoxyalkylene residues of the inventive additives. The average molecular weight of the polyoxyalkylene residue of inventive example 8 is 1.5 times greater compared to inventive example 7 and shows a significantly worse filling behaviour. This indicates that a smaller average molecular weight of the polyoxyalkylene residues in the inventive additive allows for improved copper fillings of recessed structures.

Inventive examples 10 to 15 made use of additives obtained by a reaction of the same aminoglycidyl compounds and amine compounds albeit with differing molar ratios thereof. The best filling results were obtained for a molar ratio in the range of 1:0.95 to 1:1.33 of the glycidyl moieties of the aminoglycidyl compound and the amino groups of the amine compound. Also, inventive examples 17 and 18 allow for a similar conclusion. The additives were again obtained by a reaction of the same aminoglycidyl compound and amine compound with differing molar ratios thereof. While only 40 mg/L of inventive examples 17 having a 1:1 molar mixture of glycidyl moieties of the aminoglycidyl compound to amino groups of the amine compound was required for the filling, 200 mg/L of inventive example 18 were required for the same results. The latter had a molar ratio of 1:0.75 of glycidyl moieties of the aminoglycidyl compound to amino groups of the amine compound.

Comparative Examples C1 to C3: 1,3-Bisaminopropanol Derivatives Having No Polyoxyalkylene Residue Comparative Examples C1 to C3 were prepared according to Preparation Example 1. The details are shown in Table 4.

TABLE 4

Preparation Conditions for Comparative Examples C1 to C3.

| # | Reactant 1 | Reactant 2 | Molar ratio | Solvent | t [h] | T [° C.] |
|---|---|---|---|---|---|---|
| C1 | Glycidyltrimethyl-ammonium chloride | Jeffamine ED-400 | 1:1 | $H_2O$ | 8 | 90 |
| C2 | Tris(2,3-epoxypropyl)isocyanurate | Isopentylamine | 1:2.9 | $H_2O$ | 8 | 90 |
| C3 | 4,4'-Methylene-bis (N,N'-diglycidyl-aniline) | Isopentylamine | 1:3.9 | $H_2O$ | 8 | 90 |

The identical setup which was used to test Inventive Examples 1 to 26 was used for Comparative Examples C1 to C3. The results are summarized in Table 5.

TABLE 5

TSV copper filling results of comparative examples C1 to C3.

| # | c (additive) [mg/l] | Filling [%] |
|---|---|---|
| C1 | 10-200 | 0 |
| C2 | 40 | 40 |
| C3 | 0* | — |

*insoluble product

Comparative example C1 in Table 5 was an ammonium derivative bearing a permanently quaternized nitrogen atom. Upon using it in an identical setup as the inventive examples, it did not show any copper filling of TSVs. Comparative examples C2 and C3 did not contain any polyalkyleneoxide residues and they also did not allow for sufficient copper filling of TSVs. They either failed to show complete filling of TSVs (C2) or were not soluble in the copper plating bath (C3).

Comparative Examples C4 to C7: Polyetheramines as Additives

The identical setup which was used to test Inventive Examples 1 to 26 was used for Comparative Examples C4 to C7. C4 to C7 addressed several polyetheramines as additives in an identical setup as used for the inventive examples. The results are summarized in Table 6.

TABLE 6

TSV copper filling results of polyetheramines (comparative examples C4 to C7).

| # | Additive | c (additive) [mg/l] | Filling [%] |
|---|---|---|---|
| C4 | Jeffamine ® M-600 | 10-200 | 10 |
| C5 | Jeffamine ® M-1000 | 10-200 | 0 |
| C6 | Jeffamine ® M-2070 | 10-200 | 10 |
| C7 | Jeffamine ® ED-600 | 10-200 | 0 |

None of the polyetheramine products used showed a sufficient copper filling of TSVs. Thus, it can be clearly deduced from the data that polyetheramines themselves do not allow for copper filling of TSVs.

Inventive Example 27 and Comparative Example C8: Comparison of Plating Rate

Conditions for both additives were optimised to avoid skip plating and are given hereinbelow:

a) Inventive Example 27

Through-silicon vias (TSVs) in silicon wafer substrates having a width of 10 μm and a depth of 110 μm were filled with copper using an aqueous acidic copper electrolyte comprising 50 g/l copper ions (added as copper sulphate), 20 g/l sulphuric acid, 20 mg/l chloride ions, 1 mg/l Bis-(3-sulphopropyl)-disulphide and 200 mg/l of inventive additive 26. Soluble anodes and a Nafion® membrane separating anolyte and catholyte were used. A current density of 2 mA/cm$^2$ was applied to the silicon wafer substrates for 65 min in order to fill the TSVs with copper.

b) Comparative Example C8

Through-silicon vias (TSVs) in silicon wafer substrates having a width of 10 μm and a depth of 110 μm were filled with copper using an aqueous acidic copper electrolyte comprising 55 g/l copper ions (added as copper sulphate), 50 g/l sulphuric acid, 30 mg/l chloride ions, 2.2 mg/l Bis-(3-sulphopropyl)-disulphide and 15 ml/l Spherolyte Leveller 10 (from Atotech Deutschland GmbH). Soluble anodes and a Nafion® membrane separating anolyte and catholyte were used. A current density of 2 mA/cm$^2$ was applied to the silicon wafer substrates for 105 min in order to fill the TSVs with copper. The via is filled completely without defects such as voids.

TABLE 7

Filling time of recessed structures (10 × 110 μm TSVs).

| # | Additive | c (additive) [mg/l] | Complete Filling time [min] |
|---|---|---|---|
| 27 | Inventive example 16 | 200 | 65 |
| C8 | Polyether leveller | 15 | 105 |

The setup as described above was used for the experiments summarized in Table 7. However, the time until the TSV was completely filled (i.e. 100%) was measured in order to determine the filling speed. The copper plating baths which contained inventive additive 16 allowed for much faster filling of the TSVs than the comparative example C8 which contained a conventional polyether as leveller.

Other embodiments of the present invention will be apparent to those skilled in the art from a consideration of this specification or practice of the invention disclosed herein. It is intended that the specification and examples be considered as exemplary only, with the true scope of the invention being defined by the following claims solely.

The invention claimed is:

1. An aqueous acidic copper electroplating bath which comprises at least one source of copper ions and at least one acid characterized in that the bath further comprises at least one additive obtained by a reaction of at least one aminoglycidyl compound and at least one compound selected from ammonia and amine compounds wherein the amine compounds comprise at least one primary or secondary amino group with the proviso that the aminoglycidyl compound and/or the amine compound contains at least one polyoxyalkylene residue.

2. The aqueous acidic copper electroplating bath according to claim 1 characterized in that the at least one aminoglycidyl compounds is selected from (A1) to (A5):

(A1)

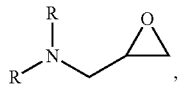

(A2)

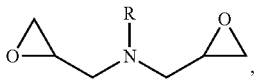

-continued (A3)

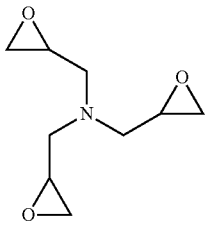

(A4)

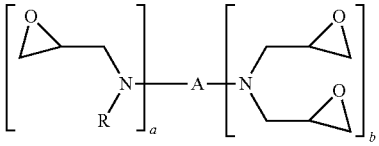

wherein each R is a monovalent residue independently selected from the group consisting of hydrogen, aliphatics, nitrogen-containing aliphatics, aralkyl, aryl, hetaryl, polyoxyalkylene and combinations of the aforementioned;

A is an (a+b)-valent hydrocarbon residue and a and b are integers each ranging from 0 to 10 with the proviso that the sum of a and b ranges from 2 to 10, or (A5)

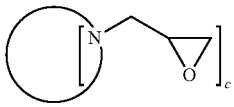

wherein (A5) is a cyclic hydrocarbon optionally comprising further heteroatoms selected from nitrogen, sulphur and/or oxygen in the ring and which consists of 4 to 12 carbon and heteroatoms; and c is an integer ranging from 1 to 6.

3. The aqueous acidic copper electroplating bath according to claim 2 characterized in that the aminoglycidyl compound is selected from the group consisting of benzyl (glycidyl)amine, N-glycidyldiethylamine, diglycidylamine, diglycidylethylamine, diglycidylmethylamine, diglycidylamine, diglycidylmethylamine, diglycidylethylamine, triglycidylamine, 4,4'-methylenebis(N,N-diglycidylaniline), 1,3-bis-(N,N-Diglycidylaminomethyl)cyclohexane, 1,3,5-tris(2-oxiranylmethyl)-1,3,5-triazinane-2,4,6-trione, 1-glycidylpiperidine, 4-glycidylmorpholine, 4-glycidylthiomorpholine, 1-glycidylpiperazine, 1-glycidylim idazol, 1-glycidylpyrazol, 1-glycidylpyrrolidine, 1-glycidyl-2-pyrolidone, 1-glycidyl-2-pyridone, 2-glycidylpyridazin-3-one, 1-furfuryl(glycidyl)amine, furfuryl(glycidyl)amine, glycidyl (tetrahydrofurfuryl)amine, 4-glycidyl-1,4-thiazepane, 1-glycidylazepane, 1-glycidylbenzimidazole, 3-glycidylthieno[2,3-d]pyrimidin-4-one, 3-glycidylthieno[3,2-d]pyrimidin-4-one and the glycidyl, diglycidyl and oligoglycidyl derivatives of polyetheramines.

4. The aqueous acidic copper electroplating bath according to claim 3 characterized in that the amine compound is selected from alkylamines; dialkylamines; alkylarylamines; aralkylamines; alkylendiamines or higher homologues thereof having the overall structure of H—(NH-G)$_g$-NH$_2$ wherein each G is an alkylene residue independently selected from each other G having 1 to 8 carbon atoms and g is an integer ranging from 1 to 6; cyclic non-aromatic amines of the following structure

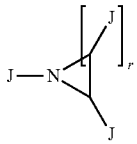

wherein each J is hydrogen, —CH$_2$—NH$_2$ or —CH$_2$—CH$_2$—NH$_2$ and r is an integer ranging from 3 to 6; arylamines; diarylamines; nitrogen-containing hetaryls with optional amine moieties bound to the hetaryl moiety; amino acids; polyetheramines; polyvinyl amines; polyallyl amines; polyethylene imines; guanidines; aminoguanidines; urea, alkylurea, dialkylurea; carbomoyl acid derivatives and esters thereof; amidinyl derivatives and salts and/or hydrates of any of the aforementioned.

5. The aqueous acidic copper electroplating bath according to claim 4 characterized in that the at least one second compound is an amine compound is selected from alkylamines, alkylendiamines or higher homologues thereof having the overall structure of H—(NH-G)$_g$-NH$_2$ wherein each G is an alkylene residue independently selected from each other G having 2 to 5 carbon atoms and g ranges from 1 to 4, cyclic non-aromatic amines of the following structure

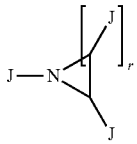

wherein each J is hydrogen, —CH$_2$—NH$_2$ or —CH$_2$—CH$_2$—NH$_2$ and r is 3 or 4 with the proviso that only one or no J is other than hydrogen; arylamines; nitrogen-containing hetaryls with optional amine moieties bound to the hetaryl moiety; polyetheramines; aminoguanidines and salts and/or hydrates of any of the aforementioned.

6. The aqueous acidic copper electroplating bath according to claim 1 characterized in that the aminoglycidyl compound is selected from the group consisting of benzyl (glycidyl)amine, N-glycidyldiethylamine, diglycidylamine, diglycidylethylamine, diglycidylmethylamine, diglycidylamine, diglycidylmethylamine, diglycidylethylamine, triglycidylamine, 4,4'-methylenebis(N,N-diglycidylaniline), 1,3-bis-(N,N-Diglycidylaminomethyl)cyclohexane, 1,3,5-tris(2-oxiranylmethyl)-1,3,5-triazinane-2,4,6-trione, 1-glycidylpiperidine, 4-glycidylmorpholine, 4-glycidylthiomorpholine, 1-glycidylpiperazine, 1-glycidylim idazol, 1-glycidylpyrazol, 1-glycidylpyrrolidine, 1-glycidyl-2-pyrolidone, 1-glycidyl-2-pyridone, 2-glycidylpyridazin-3-one, 1-furfuryl(glycidyl)amine, furfuryl(glycidyl)amine, glycidyl (tetrahydrofurfuryl)amine, 4-glycidyl-1,4-thiazepane, 1-glycidylazepane, 1-glycidylbenzimidazole, 3-glycidylthieno[2,3-d]pyrimidin-4-one, 3-glycidylthieno[3,2-d]pyrimidin-4-one and the glycidyl, diglycidyl and oligoglycidyl derivatives of polyetheramines.

7. The aqueous acidic copper electroplating bath according to claim 6 characterized in that the amine compound is selected from alkylamines; dialkylamines; alkylarylamines; aralkylamines; alkylendiamines or higher homologues thereof having the overall structure of H—(NH-G)$_g$-NH$_2$ wherein each G is an alkylene residue independently selected from each other G having 1 to 8 carbon atoms and g is an integer ranging from 1 to 6; cyclic non-aromatic amines of the following structure

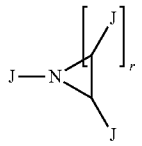

wherein each J is hydrogen, —CH$_2$—NH$_2$ or —CH$_2$—CH$_2$—NH$_2$ and r is an integer ranging from 3 to 6; arylamines; diarylamines; nitrogen-containing hetaryls with optional amine moieties bound to the hetaryl moiety; amino acids; polyetheramines; polyvinyl amines; polyallyl amines; polyethylene imines; guanidines; aminoguanidines; urea, alkylurea, dialkylurea; carbomoyl acid derivatives and esters thereof; amidinyl derivatives and salts and/or hydrates of any of the aforementioned.

8. The aqueous acidic copper electroplating bath according to claim 7 characterized in that the at least one second compound is an amine compound is selected from alkylamines, alkylendiamines or higher homologues thereof having the overall structure of H—(NH-G)$_g$-NH$_2$ wherein each G is an alkylene residue independently selected from each other G having 2 to 5 carbon atoms and g ranges from 1 to 4, cyclic non-aromatic amines of the following structure

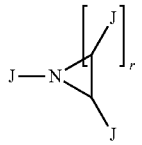

wherein each J is hydrogen, —CH$_2$—NH$_2$ or —CH$_2$—CH$_2$—NH$_2$ and r is 3 or 4 with the proviso that only one or no J is other than hydrogen; arylamines; nitrogen-containing hetaryls with optional amine moieties bound to the hetaryl moiety; polyetheramines; aminoguanidines and salts and/or hydrates of any of the aforementioned.

9. The aqueous acidic copper electroplating bath according to claim 1 characterized in that the amine compound is selected from alkylamines; dialkylamines; alkylarylamines; aralkylamines; alkylendiamines or higher homologues thereof having the overall structure of H—(NH-G)$_g$-NH$_2$ wherein each G is an alkylene residue independently selected from each other G having 1 to 8 carbon atoms and g is an integer ranging from 1 to 6; cyclic non-aromatic amines of the following structure

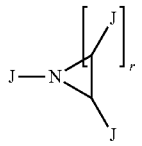

wherein each J is hydrogen, —CH$_2$—NH$_2$ or —CH$_2$—CH$_2$—NH$_2$ and r is an integer ranging from 3 to 6; arylamines; diarylamines; nitrogen-containing hetaryls with optional amine moieties bound to the hetaryl moiety; amino acids; polyetheramines; polyvinyl amines; polyallyl amines; polyethylene imines; guanidines; aminoguanidines; urea, alkylurea, dialkylurea; carbomoyl acid derivatives and esters thereof; amidinyl derivatives and salts and/or hydrates of any of the aforementioned.

10. The aqueous acidic copper electroplating bath according to claim 9 characterized in that the at least one second compound is an amine compound is selected from alkylamines, alkylendiamines or higher homologues thereof having the overall structure of H—(NH-G)$_g$-NH$_2$ wherein each G is an alkylene residue independently selected from each other G having 2 to 5 carbon atoms and g ranges from 1 to 4, cyclic non-aromatic amines of the following structure

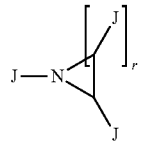

wherein each J is hydrogen, —CH$_2$—NH$_2$ or —CH$_2$—CH$_2$—NH$_2$ and r is 3 or 4 with the proviso that only one or no J is other than hydrogen; arylamines; nitrogen-containing hetaryls with optional amine moieties bound to the hetaryl moiety; polyetheramines; aminoguanidines and salts and/or hydrates of any of the aforementioned.

11. The aqueous acidic copper electroplating bath according to claim 1 characterized in that the molar ratio of glycidyl moieties of one or more aminoglycidyl compounds and amino groups of the one or more amine compounds and/or ammonia is in the range of 1:0.8 and 1:1.5.

12. The aqueous acidic copper electroplating bath according to claim 1 characterized in that the polyoxyalkylene residues have been formed by propylene oxide and ethylene oxide in a molecular ratio of at least 0.25 mole propylene oxide per mole ethylene oxide.

13. The aqueous acidic copper electroplating bath according to claim 1 characterized in that the at least one additive bears at least one polyoxyalkylene residue having a molecular weight $M_w$ in the range of 100 to 10,000 g/mol.

14. The aqueous acidic copper electroplating bath according to claim 1 characterized in that at least one additive is one according to formula (I) to (III)

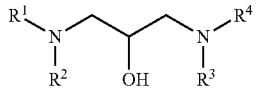

(I)

wherein $R^1$ and $R^2$ are monovalent residues independently from each other selected from the group consisting of hydrogen, aliphatics, nitrogen-containing aliphatics, aryl, hetaryl, alkaryl, carbamoyl, amidinyl, guanyl, ureyl, and polyoxyalkylene;

$R^3$ and $R^4$ are monovalent residues independently from each other selected from the group consisting of hydrogen, aliphatics, nitrogen-containing aliphatics, aryl, hetaryl, alkaryl and polyoxyalkylene and

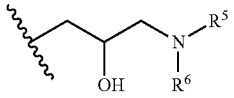

with $R^5$ and $R^6$ being monovalent residues independently from each other selected from the group consisting of hydrogen, aliphatics, nitrogen-containing aliphatics, aryl, hetaryl, alkaryl, carbamoyl, amidinyl, guanyl, ureyl, and polyoxyalkylene;

with the proviso that at least one monovalent residue of $R^1$ to $R^6$ is selected to be polyoxyalkylene;

(II)

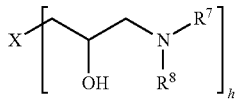

wherein $R^7$ and $R^8$ are monovalent residues independently from each other selected from the group consisting of hydrogen, aliphatics, nitrogen-containing aliphatics, aryl, hetaryl, alkaryl, carbamoyl, amidinyl, guanyl, ureyl, and polyoxyalkylene;

h is an integer ranging from 2 to 6;

X is an h-valent residue selected from the group consisting of

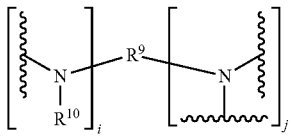

and

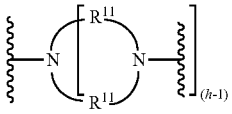

wherein $R^9$ is a linear and/or cyclic, branched or unbranched alkylene of 1 to 12 carbon atoms, arylene and combinations thereof;

$R^{10}$ is a monovalent residue selected from the group consisting of hydrogen, aliphatics, nitrogen-containing aliphatics, aryl, hetaryl, alkaryl, and polyoxyalkylene;

i is an integer ranging from 0 to h and j is an integer ranging from 0 to h/2 with the proviso that the sum of i and 2*j equals h;

and each $R^{11}$ is a divalent residue independently selected from each other —$(CH_2)_k$— with k being an integer ranging from 1 to 7, —C(O)—, —$CH_2$—$CH_2$—O—$CH_2$—$CH_2$—, —CH═CH—CH═CH—, —CH═CH—N═CH—, —CH═CH—N═N—, —CH═CH—CH═N—, —CH═CH—CH═CH—CH═N—, —CH═CH—CH═CH—N═CH—, and —CH═CH—CH═N—CH═CH— with the proviso that at least one residue of $R^7$, $R^8$ and to $R^{10}$ is selected to be polyoxyalkylene; and (III)

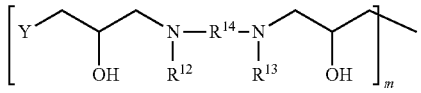

$R^{12}$ and $R^{13}$ are monovalent residues independently selected from the group consisting of hydrogen, aliphatics, nitrogen-containing aliphatics, aryl, hetaryl, alkaryl, carbamoyl, amidinyl, guanyl, ureyl, and polyoxyalkylene;

$R^{14}$ is a divalent residue selected from alicyclic and/or cyclic, branched or unbranched alkylene, arylene, polyoxyalkylene and combinations thereof;

m is an integer ranging from 1 to 25;

Y is an at least divalent residue selected from the group consisting of

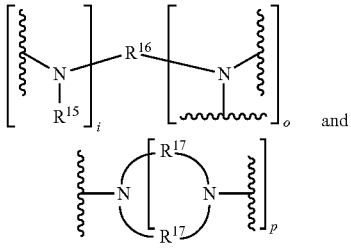

and wherein $R^{15}$ is selected from the group consisting of hydrogen, linear and/or cyclic, branched or unbranched alkyl, aryl, aralkyl and polyalkoxylene;

$R^{16}$ is an hydrocarbon residue having a valency of the sum of n and o selected from linear and/or cyclic, branched or unbranched alkylene of 1 to 12 carbon atoms, arylene and combinations thereof;

n is an integer ranging from 0 to 10 and o is an integer ranging from 0 to 10 with the proviso that the sum of n and o ranges from 1 to 10;

p is an integer ranging from 2 to 5;

each $R^{17}$ is independently selected from each other —$(CH_2)_q$— with q being an integer ranging from 1 to 7, —C(O)—, —$CH_2$—$CH_2$—O—$CH_2$—$CH_2$—, —CH═CH—CH═CH—, —CH═CH—N═CH—, —CH═CH—N═N—, —CH═CH—CH═N—, —CH═CH—CH═CH—CH═N—, —CH═CH—CH═CH—N═CH—, and —CH═CH—CH═N—CH═CH— with the proviso that at least one residue of $R^{12}$ to $R^{16}$ is selected to be polyoxyalkylene.

15. The aqueous acidic copper electroplating bath according to claim 1 characterized in that the concentration of the additive ranges from 1 mg/l to 500 mg/l.

16. A method for deposition of copper onto a substrate comprising the steps (i) providing a substrate and (ii) contacting the substrate with an aqueous acidic copper electroplating bath according to claim 1, (iii) applying an electrical current between the substrate and at least one anode, and thereby depositing copper onto the substrate.

17. The method for deposition of copper onto a substrate according to claim 16 wherein the substrate is selected from the group consisting of printed circuit boards, IC substrates, semiconducting wafers, ceramics and glass substrates.

18. The method for deposition of copper onto a substrate according to claim 17 wherein the copper is deposited into recessed structures selected from the group consisting of trenches, blind micro vias, through holes, through silicon vias and through glass vias.

19. The method for deposition of copper onto a substrate according to claim 16 wherein the copper is deposited into recessed structures selected from the group consisting of trenches, blind micro vias, through holes, through silicon vias and through glass vias.

20. A method for deposition of a metal or metal alloy onto a substrate comprising the steps providing a substrate, contacting the substrate with an aqueous acidic metal or metal alloy plating bath comprising at least one source of metal ions and at least one acid, and an additive obtained by a reaction of at least one aminoglycidyl compound comprising at least one amino group which bears at least one glycidyl moiety and at least one second compound selected from ammonia and amine compounds wherein the amine compounds comprise at least one primary or secondary amino group with the proviso that the aminoglycidyl compound contains at least one polyoxyalkylene residue and/or the amine compound contains at least one polyoxyalkylene residue, and depositing metal or metal alloy onto the substrate.

* * * * *